US006364459B1

(12) United States Patent
Sharma et al.

(10) Patent No.: US 6,364,459 B1
(45) Date of Patent: Apr. 2, 2002

(54) PRINTING APPARATUS AND METHOD UTILIZING LIGHT-ACTIVATED INK RELEASE SYSTEM

(75) Inventors: Ravi Sharma, Fairport, NY (US); Nicholas L. Abbott, Madison, WI (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/412,148

(22) Filed: Oct. 5, 1999

(51) Int. Cl.[7] ..... B41J 2/14
(52) U.S. Cl. ..... 347/51; 347/38
(58) Field of Search ..... 347/51, 38

(56) References Cited

U.S. PATENT DOCUMENTS

| | | | | |
|---|---|---|---|---|
| 4,258,367 A | * | 3/1981 | Mansukhani | 347/101 |
| 4,607,267 A | | 8/1986 | Yamamuro | 347/51 |
| 4,611,486 A | | 9/1986 | Stockhausen | 73/64.48 |
| 5,102,856 A | * | 4/1992 | Doll et al. | 503/209 |
| 5,742,412 A | * | 4/1998 | Minemoto et al. | 359/55 |
| 5,841,448 A | | 11/1998 | Moriyama et al. | 347/19 |
| 5,857,410 A | | 1/1999 | Watannabe et al. | 101/116 |
| 6,126,270 A | * | 10/2000 | Lebens et al. | 347/48 |

FOREIGN PATENT DOCUMENTS

| | | | |
|---|---|---|---|
| EP | 0771658 A2 | | 7/1997 |
| JP | 04266974 A | * | 9/1992 |

OTHER PUBLICATIONS

European Search Report, EP 00 20 3317 Widmier W. Jan. 11, 2001.

Jason Y. Shin and Nicholas L. Abbott, Using Light to Control Dynamic Surface Tensions of Aqueous Solutions of Water Soluble Surfactants, In Final Form: Mar. 15, 1999, 1999 American Chemical Society published on Web May 18, 1999; vol. 15, No. 13, 1999; pp. 4404–4410.

* cited by examiner

*Primary Examiner*—N. Le
*Assistant Examiner*—Shih-wen Hsieh
(74) *Attorney, Agent, or Firm*—David A. Novais

(57) ABSTRACT

A printing apparatus in the form of an inkjet printer and a printing method utilizes a light-activated ink release system. The apparatus includes at least one nozzle having an ink body that is comprised of light-sensitive ink. The ink can form an unextended droplet meniscus. By directing a light beam onto the unextended droplet meniscus, the surface tension of the light-sensitive ink decreases, and provides for an extended droplet meniscus. The formation of the extended meniscus droplet meniscus permits the transfer of ink to a receiver or media.

20 Claims, 8 Drawing Sheets

PRINTING APPARATUS AND METHOD UTILIZING LIGHT-ACTIVATED INK RELEASE SYSTEM

FIELD OF THE INVENTION

The present invention relates to a printing apparatus in the form of a drop on demand (DOD) inkjet printer and a printing method in which a light-activated ink release system is utilized.

BACKGROUND OF THE INVENTION

In the printing art inkjet printers are known which eject ink drops from an inkjet head toward a paper to print out desired information on the paper. In conventional inkjet printer arrangements, the ejection of ink drops can be implemented by various types of inkjet heads such as a magnetic on demand types or an on demand-type of head using an inorganic electro-restrictive element. Further, in conventional inkjet printer arrangements, light beams have been used as a measuring tool to measure properties of the ink.

U.S. Pat. No. 5,841,448, discloses an inkjet head arrangement in which an LED emits light onto a photodiode, then measurements as a result of the emission of the light are utilized for detecting an amount of ink, an ink density, etc.

U.S. Pat. No. 4,607,267 discloses the use of an electromagnetic wave to cause a certain component of ink to chemically react in a reaction chamber to generate a gas. The resulting pressure of the gas causes an inkjet drop to be ejected.

U.S. Pat. No. 4,611,486 discloses the use of a light source as a tool to measure and/or monitor a surface tension of a fluid.

Prior arrangements including the above-mentioned patents do not show or suggest the specific use of light-sensitive ink to create an ink droplet, as well as the concept of printing by aiming a light beam at an unextended ink droplet to cause an extension of the unextended ink droplet.

SUMMARY OF THE INVENTION

The present invention provides for an ink release mechanism for use in a DOD inkjet printer, in which a light-sensitive ink forms an extended ink droplet when a light beam is directed onto it.

With the apparatus and method of the present invention, it is possible to selectively aim a light beam at an array of nozzles having unextended ink droplets, so as to cause the unextended selected ink droplets to extend and permit the transfer of the ink to a receiver or media.

The present invention relates to a printing apparatus that comprises at least one nozzle. The at least one nozzle comprises a channel which has an ink body disposed therein that is comprised of light-sensitive ink. The channel of the at least one nozzle leads to a nozzle outlet such that an unextended droplet meniscus attached to the ink body is located at the nozzle outlet. The printing apparatus further comprises a light source that is adapted to direct a light beam to the unextended droplet meniscus to cause an extension of the unextended droplet meniscus, so as to form an extended droplet meniscus and permit ink to be transferred to a receiver which is disposed relative to the extended droplet meniscus.

The present invention further provides for a printing method that comprises the steps of forming unextended light-sensitive droplet menisci at outlets of a plurality of nozzles; impinging a light beam onto at least one of the unextended ink droplet menisci to form an extended droplet meniscus; and transferring ink from the extended droplet meniscus onto a receiver.

The present invention further provides for a printing apparatus that comprises at least one nozzle. The at least one nozzle includes a channel having an ink body disposed therein. The channel of the at least one nozzle leads to a nozzle outlet such that an ink droplet meniscus attached to the ink body is located at the nozzle outlet. The ink body comprises light sensitive ink having a surface tension which decreases when exposed to light so as to cause an outward extension of the ink droplet meniscus when exposed to light.

The present invention also relates to a method of assembling a printing apparatus which comprises the steps of: providing at least one nozzle on a printing apparatus having an ink holding area which leads to a nozzle outlet; providing light sensitive ink in the ink holding area such that an ink body is formed in the ink holding area and an unextended droplet meniscus attached to the ink body is located at the nozzle outlet; and providing a light source at a position relative to said unextended droplet meniscus to direct a light beam onto the unextended droplet meniscus, so as to cause an extension of the unextended droplet meniscus and form an extended droplet meniscus.

DETAILED DESCRIPTION OF THE INVENTION

Figure 1A:
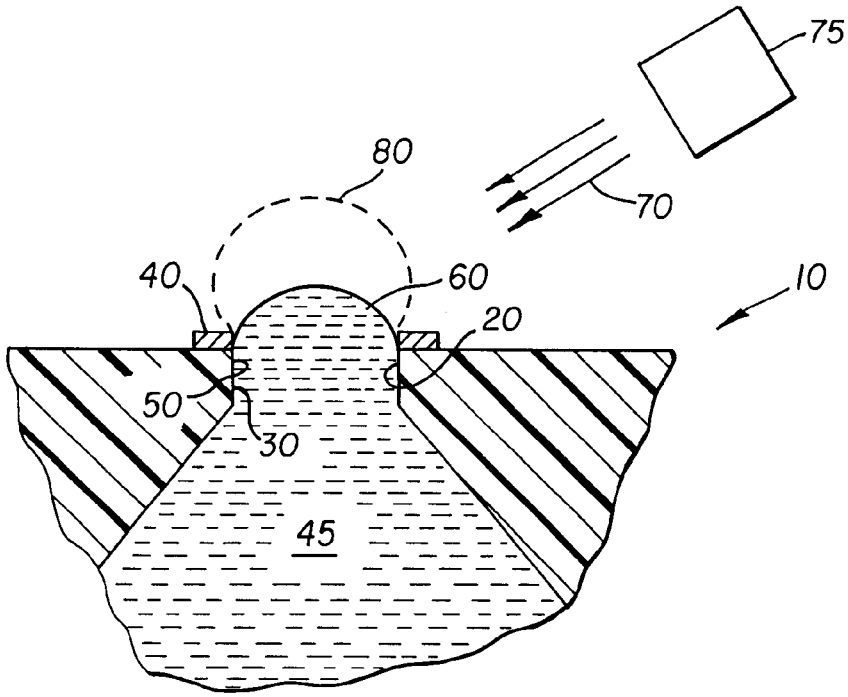
FIG. 1A shows a single ink ejection nozzle of an array of ink ejection nozzles of a printhead being illuminated.

Referring now to the drawings, wherein like reference numerals represent identical or corresponding parts throughout the several views, FIG. 1A illustrates a printhead 10 having an array of ink ejection nozzles 20 (only one ink ejection nozzle is shown in FIG. 1A). Printhead 10 is part of an inkjet printing apparatus which ejects drops of ink from an inkjet head toward a receiver to print out desired information on the receiver. Each nozzle 20 includes a channel 30 that is formed in printhead 10. As an option, an annular resistive heater 40 can be located in the vicinity of a nozzle outlet 50 so as to enable a selective energizing at nozzle outlet 50. Disposed in channel 30 is an ink body 45 within an ink holding area which includes light-sensitive ink in accordance with the present invention. Attached to ink body 45 is an unextended droplet meniscus 60 which is outwardly poised at nozzle outlet 50 due to a predetermined pressure that acts on ink body 45. An example of a light sensitive ink which can be used is a dye or a pigment in a mixed surfactant system containing sodium dodecyl sulfate, SDS, and 4, 4'-bis (trimethylammoniumhexyloxy) azobenzenebromide, BTHA.

As further shown in FIG. 1A, a light source 75 can direct a light beam 70 onto unextended droplet meniscus 60. Due to the use of light-sensitive ink, the application of light beam 70 onto unextended droplet meniscus 60 will cause the unextended droplet meniscus 60 to extend outwardly from nozzle outlet 50 upon exposure to light beam 70. In a preferred embodiment of the present invention, light beam 70 has a predetermined wave length, and the ink is chosen so as to be light sensitive and thereby have a surface tension or pressure which rapidly decreases when exposed to light. In an embodiment of the present invention in which an array of nozzles with unextended menisci is present, light source 75 can be selectively positioned so as to precisely direct light beam 70 to a selected one of the unextended menisci 60. When light beam 70 impinges the selected unextended meniscus 60, meniscus 60 will extended outwardly from nozzle outlet 50 and form extended meniscus 80.

Figure 1B:
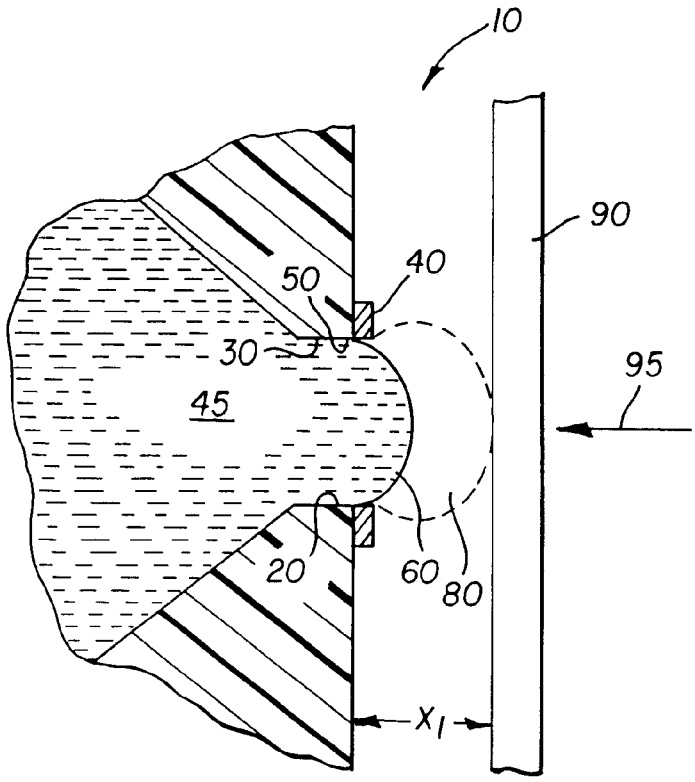
FIG. 1B shows an extended ink droplet meniscus of the ink ejection nozzle of FIG. 1A.

As shown in FIG. 1B, immediately after extended meniscus 80 is formed, printhead 10 can be rotated (for example, 90°). At this point, a receiver or media 90 can be moved into contact with extended meniscus 80, such as in a direction of an arrow 95 so as to be a distance $X_1$ from nozzle 20, so that one or more ink droplets are transferred to receiver 90.

Figure 2:
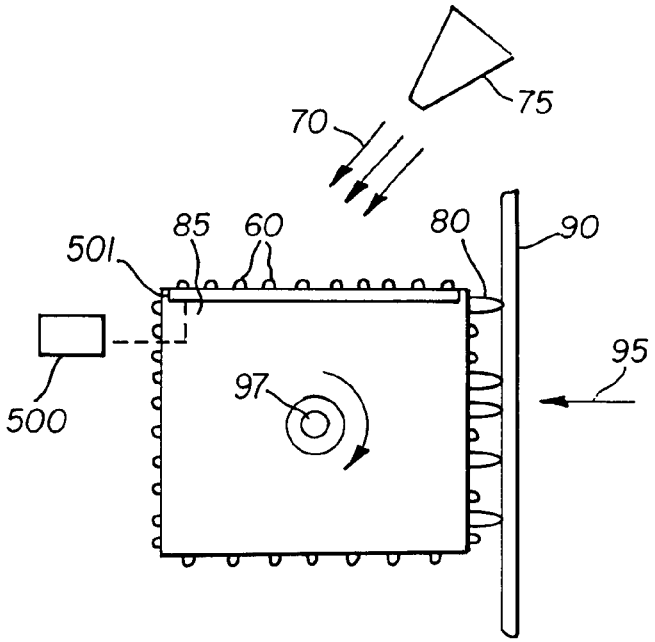
FIG. 2 is an example of an apparatus of the present invention in which the nozzles can be mounted on a rotating carousel arrangement.

In a first embodiment of the present invention, an array of nozzles 20 can be provided on a multi-sided carousel 85 which rotates about a spindle 97 as shown in FIG. 2. Carousel 85 will have unextended menisci 60 on at least two sides and in the example illustrated in FIG. 2, the unextended menisci 60 are on all four sides of carousel 85. When it is desired to print, carousel 85 can be rotated so that the unextended menisci 60 onto which light beam 70 is desired to be directed faces light source 75. Light source 75 will emit light beam 70 onto the desired unextended menisci 60 to cause an extension of the menisci 60 and form extended menisci 80. Immediately thereafter, carousel 85 can be rotated as illustrated by the arrow so as to face receiver 90. Extended menisci 80 will thereby cause a transfer of ink onto receiver 90 when receiver 90 is brought into contact with extended menisci 80 by moving receiver 90 in direction 95. As a further example, it is recognized that rather than moving receiver 90 in direction 95, carousel 85 can be adapted to both rotate and move in a linear direction toward receiver 90.

Figure 3:
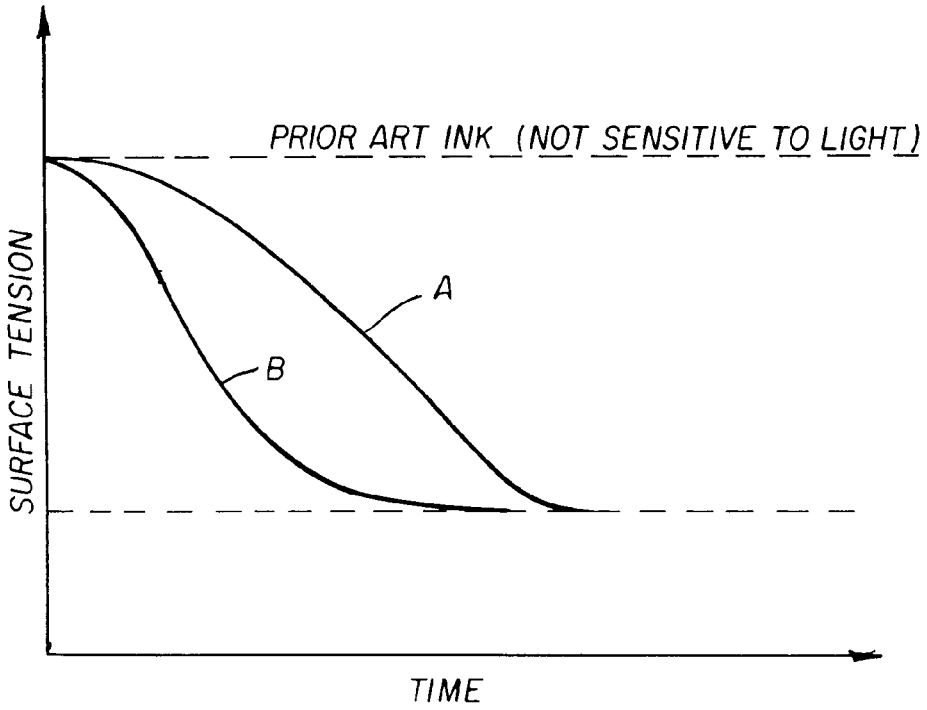
FIG. 3 is a graph of surface tension versus time comparing light-sensitive ink with conventional ink which is not light sensitive.

FIG. 3 is a graph that depicts surface tension properties of the light sensitive ink of the present invention. The graph of FIG. 3 illustrates surface tension versus time and compares the light sensitive ink of the present invention with conventional or prior art ink which is not light sensitive. As illustrated in FIG. 3, the use of light sensitive ink causes a rapid decrease of surface tension versus non-light sensitive ink. More specifically, as shown by the dashed line in FIG. 3, the surface tension of ink which is not light sensitive remains generally constant over time. Curve A in FIG. 3, which represents light sensitive ink before exposure to light, illustrates that surface tension decreases at a first rate over time, while curve B, which represents light sensitive ink after exposure to light, illustrates that surface tension decreases rapidly over time at a second rate which is greater than the first rate. This provides for an efficient method of producing the extended meniscus 80 as illustrated in FIGS. 1A, 1B and 2.

It can also be seen from FIG. 3 that unselected ink drops will achieve the lower surface tension of the selected (illuminated) ink drops, albeit at a later time. Therefore, built into the printing routine there can be provided a unit 500 (shown schematically in FIG. 2) which is adapted to withdraw or suck ink from all nozzles and quickly refill them to form a fresh meniscus in each nozzle. This is done to reset the age of the meniscus to zero, because the surface tension of old menisci will naturally decrease to a low level causing unselected drops to protrude. Thus, by implementing a meniscus-refreshing procedure, the surface age of the menisci during selection will preferably be less than 100 $\mu$s and substantially equal in age. Resetting the surface age of menisci prevents unselected drops from extending and transferring to receiver 90 when the print head and receiver 90 come into contact again. Unit 500 could be a syringe, pump, or any other device which is capable of sucking or withdrawing ink from the nozzles. Although FIG. 2 shows unit 500 being associated with a conduit 501 that leads to all the nozzles of one side of a carousel, the present invention is not limited thereto. Unit 500 can lead to a plurality of conduits that each lead to individual nozzles or can lead to a single conduit as shown. The single conduit can also include valves to selectively control which nozzle is to have the ink withdrawn or sucked therefrom. Further, a plurality of units 500 can be used with each unit being dedicated to particular nozzles.

Figure 4:
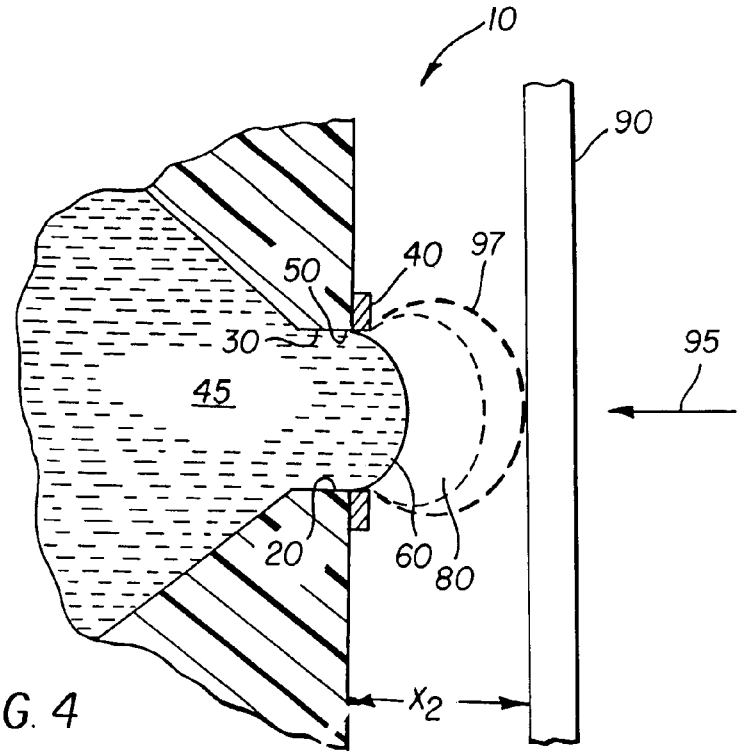
FIG. 4 shows a difference in extension between the droplet of FIG. 1A that has been illuminated and a droplet that has been illuminated and heated.

In a second embodiment of the invention, extended meniscus 80 may be caused to further extend by use of resistive heater 40 as illustrated in FIGS. 1A and 4 to form meniscus 97 as shown in FIG. 4. By using heater 40, an increased differentiation between selected drops can be realized. That is, the addition of heat from heater 40 will cause extended meniscus 80 to further outwardly extend so that receiver 90 need not be placed as near to nozzle 20 to reliably obtain precise ink droplet placement; i.e., distance $X_1$ in FIG. 1B is less than distance $X_2$ in FIG. 4. An advantage of this embodiment is that the need to maintain an extremely small distance between receiver 90 and nozzle 20 is minimized. Another advantage of this embodiment is that the need to maintain a tight tolerance on the thickness of the receiver is relaxed. A tight tolerance in the thickness of receiver 90 is required because the elevation difference between selected and unselected ink drops could be less than 10 $\mu$m which forces the thickness of the receiver to vary by less than that amount.

Figure 5:
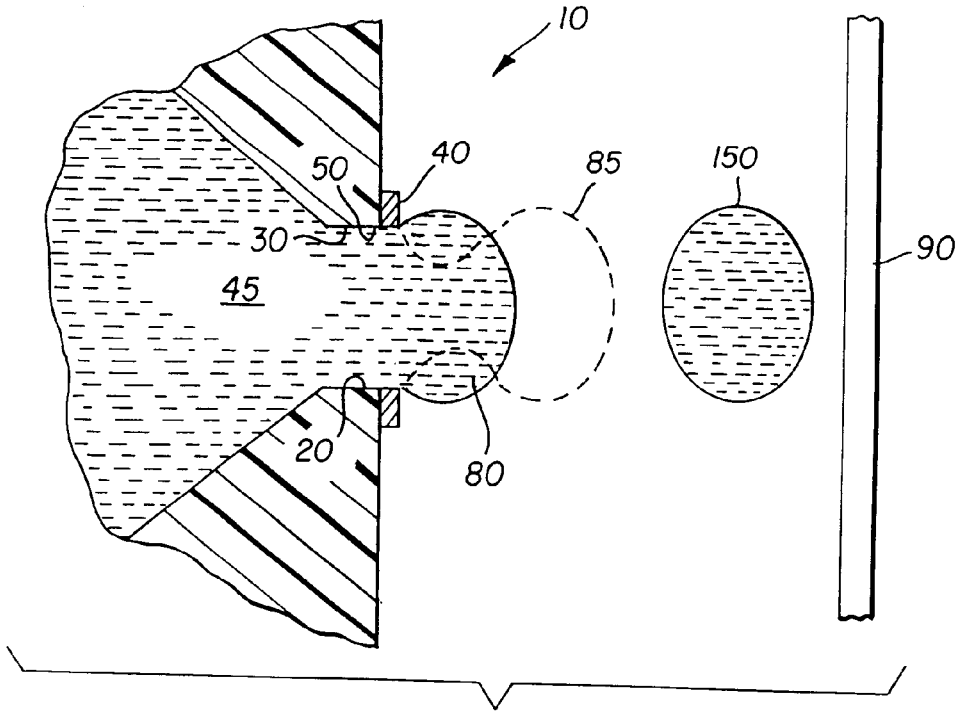
FIG. 5 shows the droplet of FIG. 1A that has been caused to pinch-off and release by the co-action of light and heat.

Referring to FIGS. 1A and 5, a third embodiment of the present invention will now be described. As shown in FIG. 5, extended meniscus 80 can be caused to further extend to form meniscus 85 and release a drop 150 by use of resistive heater 40. That is, the addition of heat from heater 40 will cause extended meniscus 80 to further outwardly extend and ultimately pinch-off and fly toward receiver 90. An advantage of this embodiment is that the difficulty of accurately placing the receiver 90 close to nozzle 20 is eliminated. The amount of thermal energy required for causing extended meniscus 80 to pinch-off and fly toward receiver 90 is greater than the case when heater 40 is energized for forming extended meniscus 80.

Figure 6:
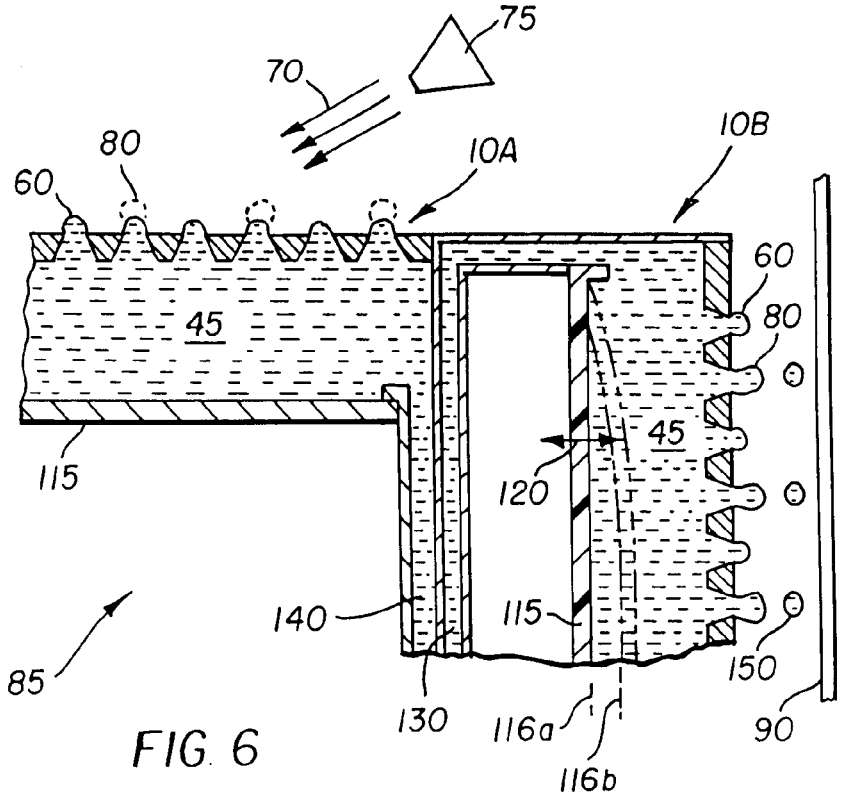
FIG. 6 shows the corner of first and second printheads configured as part of the rotating rectangular carousel of FIG. 2.
Figure 7:
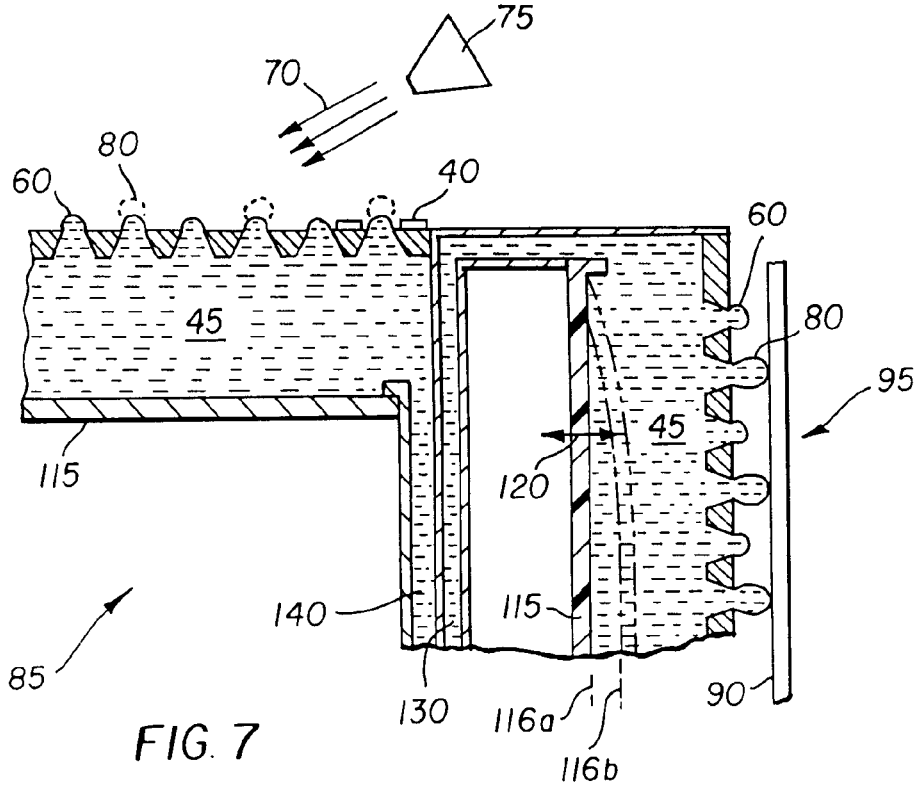
FIG. 7 shows the corner of the first and second printheads configured as part of the rotating rectangular carousel as in FIG. 6.

Referring to FIGS. 6 and 7 a fourth embodiment of the invention will now be described. As illustrated, carousel 85 includes a first printhead 10A which is shown during a pre-printing stage when droplets 60 are selectively illuminated to form extended droplets 80, and a second printhead 10B which is shown opposite receiver 90 during a printing stage. It is recognized that carousel 85 can include additional printheads and that two printheads are shown for descriptive purposes. In this embodiment, extended meniscus 80 can be caused to pinch off or fly toward receiver 90 by application of light beam 70 and the application of a second force (without use of heater 40). That is, as described above, application of a light beam to the unextended meniscus 60 reduces surface tension. However, the surface tension is not reduced to a level where the extended meniscus will fly-off the nozzle. By adding a pressure pulse to selected droplets such as through, for example, a known transducer such as a piezoelectric transducer or by an electromagnetically-operated structure or a bimorph structure, the reduced surface tension force on illuminated droplets can be overcome and selectively cause the droplets 80 to fly-off toward receiver 90.

The co-action of light and a pressure pulse is depicted in FIG. 6 which shows a corner of rectangular carousel 85 discussed previously with reference to FIG. 2. Ink menisci on printhead 10A are in the process of being selectively illuminated by light source 75 while ink menisci on printhead 10B, having already been selectively illuminated are now ejecting ink drops 150 by action of a piezoelectric transducer 115. The rest position of piezoelectric transducer 115 is shown as 116*a* and upon receiving an appropriately timed electrical signal from a controller (not shown), transducer 115 bends to position 116*b* pressurizing ink sufficiently to overcome the lower surface tension of the illuminated (selected) drops. In this situation, receiver 90 does not have to be brought into contact with extended meniscus 80 in the manner described above, rather, ink droplets 150 will fly to receiver 90. Still referring to FIG. 6, printhead 10A may contain a different ink than printhead 10B. Therefore an ink channel 140 which supplies ink to printhead 10A draws ink from a different ink reservoir than an ink channel 130 which supplies ink to printhead 10B.

In a fifth embodiment of the invention, rather than flying off as shown in FIG. 6, extended meniscus 80 may be caused to further extend and contact receiver 90 by use of light beam 70 and the second force imparted by a pressure pulse as described with reference to FIG. 6. The pressure pulse is controlled to cause extended droplets 80 to further protrude and selectively contact-transfer to receiver 90 as shown in FIG. 7. Furthermore, heater 40 may be optionally activated to co-act with the pressure pulse causing meniscus 80 to protrude and selectively contact-transfer to receiver 90.

Figure 8:
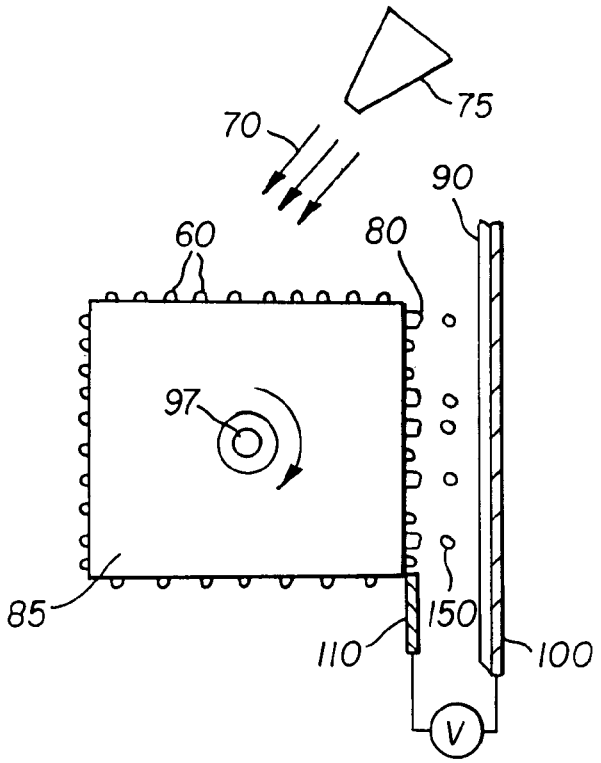
FIG. 8 is an example of an apparatus of the present invention in which the nozzles can be mounted on a rotating carousel arrangement and a charged plate is used to aid in ejecting selected droplets toward a receiver.

Continuing with the concept of adding a second force on the illuminated drops, in a sixth embodiment of the present invention, extended droplet meniscus 80 may be caused to selectively pinch-off and fly to receiver 90 by application of an electric field as shown in FIG. 8. That is, as described above, application of a light beam to the unextended meniscus 60 reduces surface tension. However, the surface tension is not reduced to a level where extended meniscus 80 will fly-off the nozzle. By applying an electric field such as through, for example, a charged platen 100 and connector 110, the lower surface tension force on droplets 80 can be overcome to selectively cause the droplets 80 to fly-off toward receiver 90. Droplets 80 may also be selectively caused to fly toward receiver 90 by optionally implementing heater 40 (as shown in FIG. 1) and/or using a pressure transducer (FIG. 6) while the electric field is also applied.

Figure 9:
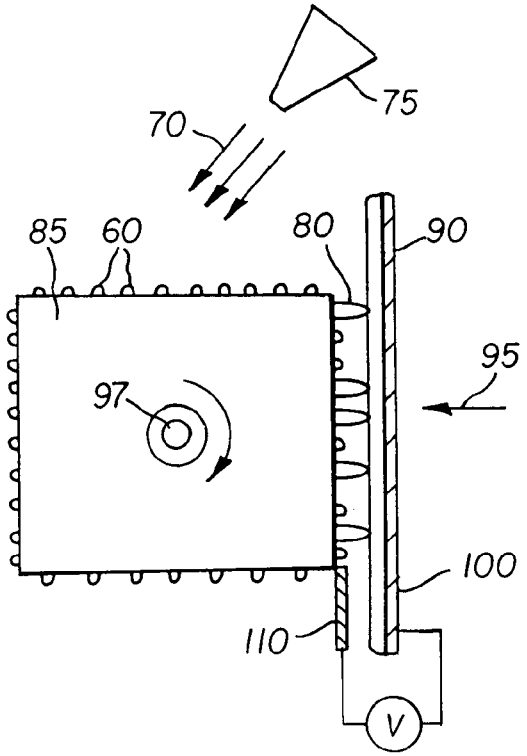
FIG. 9 is a further example of an apparatus of the present invention in which the nozzles can be mounted on a rotating carousel arrangement and a charged plate is used to aid in extending selected drops causing selected drops to contact-transfer to a receiver.

In a seventh embodiment of the invention, rather than flying off as shown in FIG. 8, extended meniscus 80 may be caused to further extend and touch receiver 90 by use of a second force such as that imparted by an electric field in the manner as shown in FIG. 9. The electric field created by platen 100 and connector 110 is adapted to cause illuminated drops (extended meniscus) 80 to further protrude and selectively contact-transfer to receiver 90. Furthermore, heater 40 (FIG. 1) and a pressure transducer (FIG. 6) may be optionally implemented to co-act with the electric field causing meniscus 80 to further protrude and selectively contact-transfer to receiver 90.

Figure 10A:
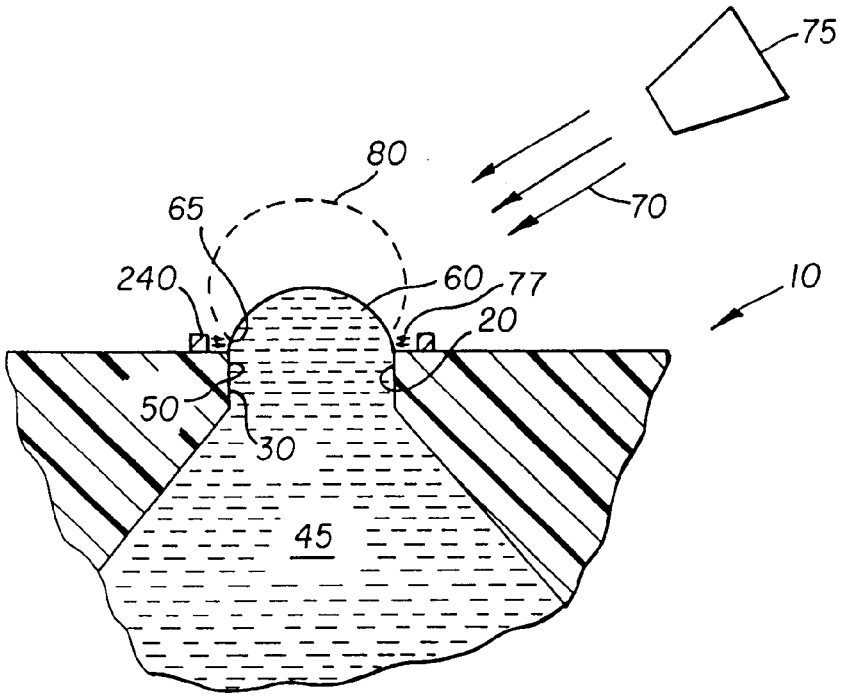
FIG. 10A shows a cross-section of a single ink ejection nozzle of an array of ink ejection nozzles of a printhead with an annular light-emitting diode surrounding a nozzle outlet.
Figure 10B:
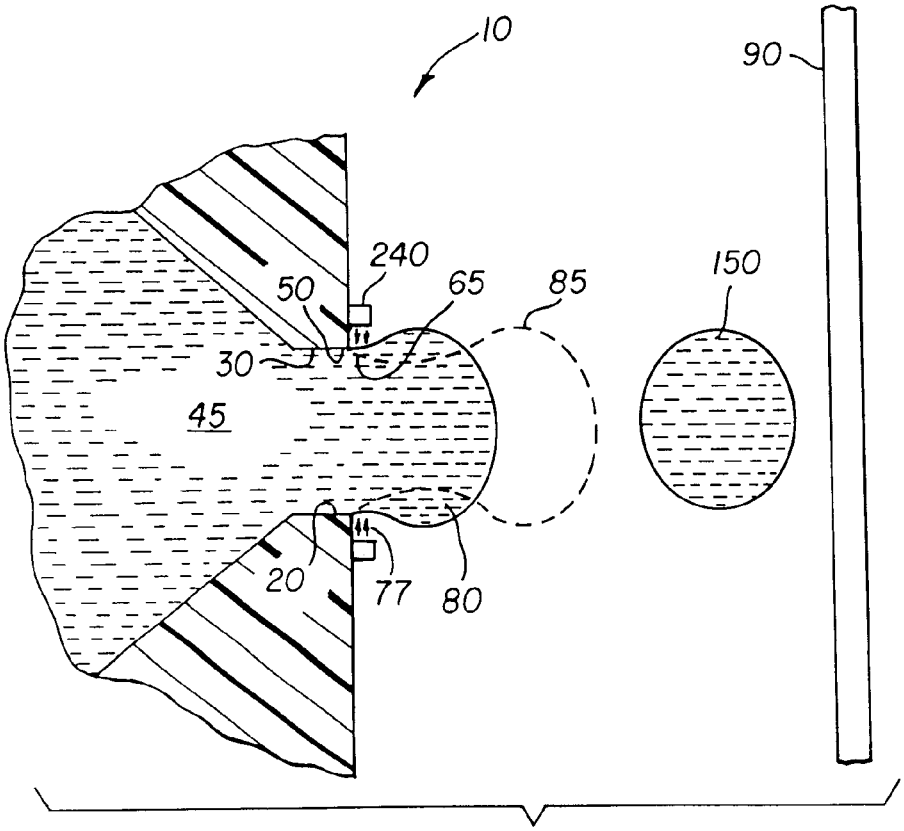
FIG. 10B shows an extended ink droplet meniscus (in phantom) of the ink ejection nozzle of FIG. 10A and an ejected ink droplet flying toward a receiver.
Figure 11A:
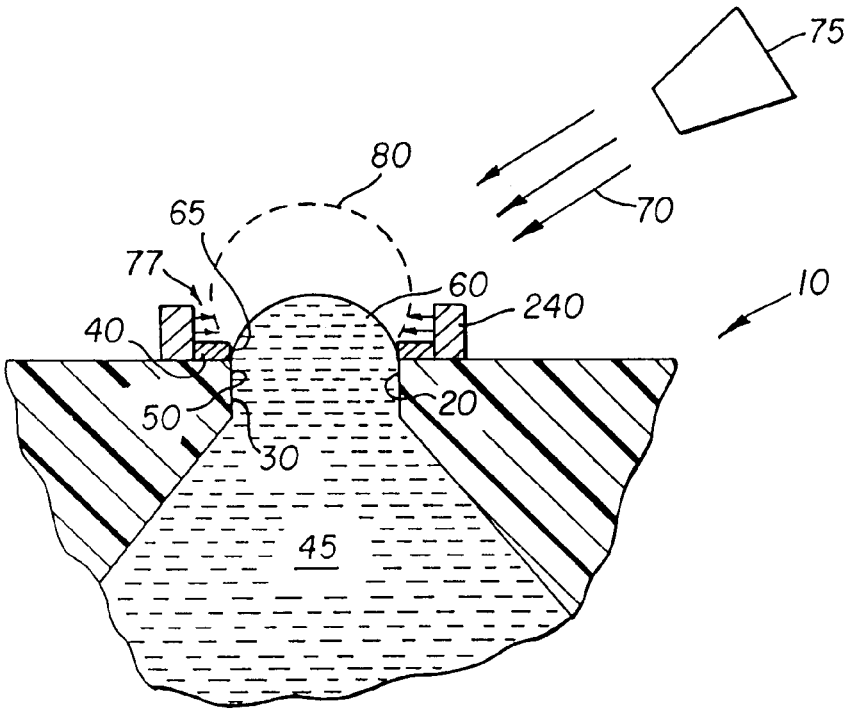
FIG. 11A shows a cross-section of a single ink ejection nozzle of an array of ink ejection nozzles of a printhead with an annular light-emitting diode and an annular heater surrounding a nozzle outlet.
Figure 11B:
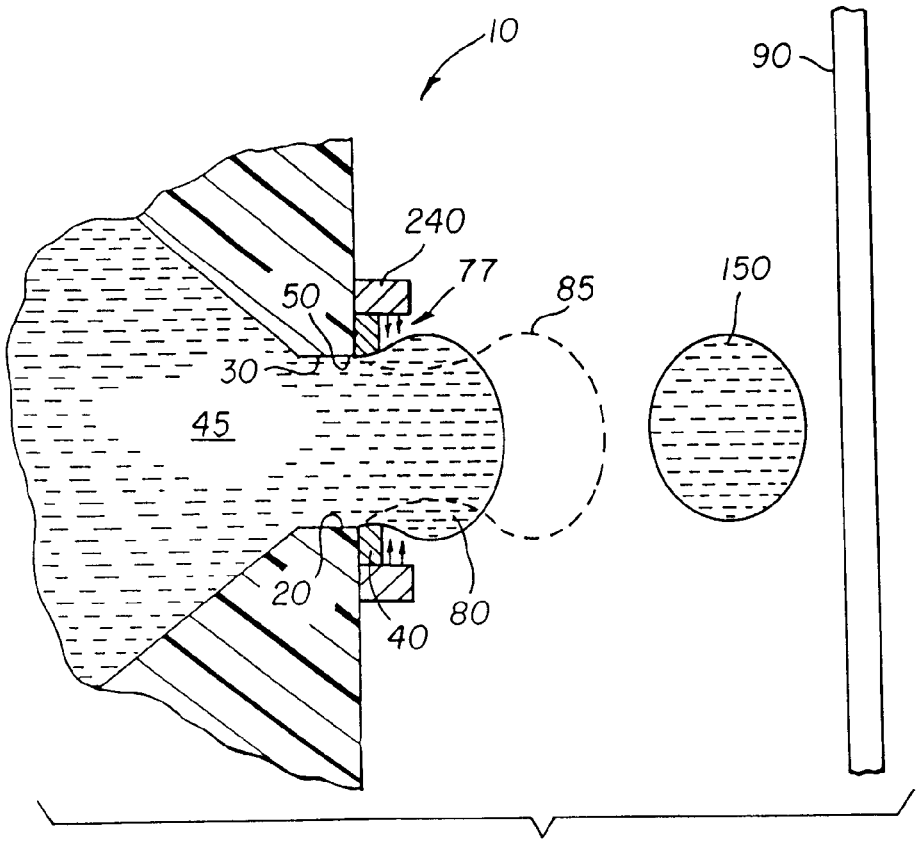
FIG. 11B shows an extended ink droplet meniscus (in phantom) of the ink ejection nozzle of FIG. 11A and an ejected ink droplet flying toward a receiver.

In an eighth embodiment of the present invention, a light emitting diode 240, preferably in the form of an annulus, is positioned around nozzle 20 as shown in FIGS. 10A and 10B. Light emitting diode 240 can be adapted to direct a light beam 77 at throat 65 of nozzle 20 which would decrease surface tension and cause the drop 80 (extended meniscus) to expand and ultimately to release and fly toward receiver 90. This may optionally be done while selected drops are additionally illuminated using light source 75. With this embodiment, selected drops 80 are caused to expand to form droplet 85 as shown in FIG. 10B and then form droplets 150 which fly-off or are released toward receiver 90 using light only. Again, a pressure pulse (FIG. 6), an electric field (FIG. 8) or heaters 40 (FIG. 1) can be implemented to co-act with light from light emitting diode 240 to enhance the release of selected drops 80. FIGS. 11A and 11B show an exemplary arrangement using the combination of light emitting diode 240 and heater 40 in the vicinity of the nozzle outlet 50.

Figure 12:
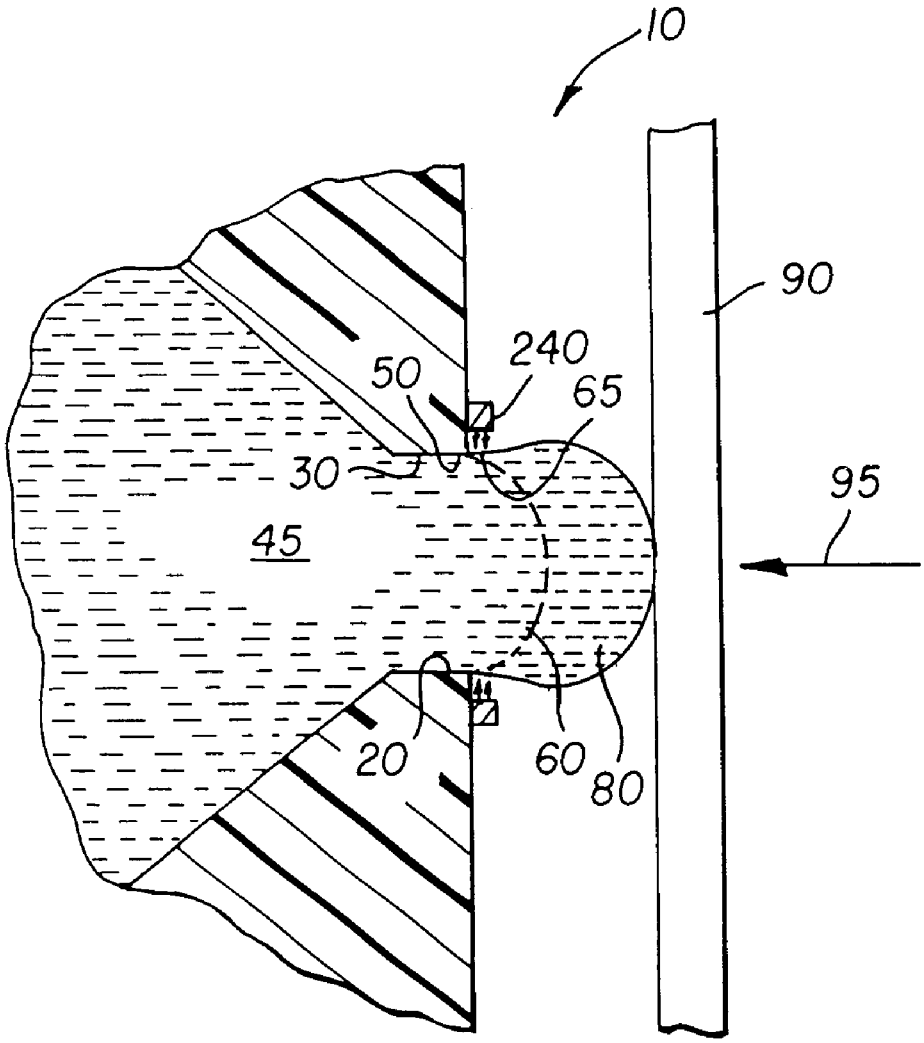
FIG. 12 shows an extended ink droplet meniscus of the ink ejection nozzle of FIG. 10A in contact with a receiver.

Referring to FIG. 12, a ninth embodiment of the present invention is illustrated. In this embodiment rather than flying off as shown in FIGS. 10B and 11B, extended droplet meniscus 80 which is further illuminated by light rays 77 from light emitting diode 240, may be caused to further protrude and contact-transfer to receiver 90 by implementation of a pressure pulse (FIG. 6), heat (FIG. 1) and/or an electric field (FIG. 8).

With respect to light source 75, a number of alternative schemes may be used to illuminate the light sensitive ink. For example, a beam of light from a single source may be directed onto the light sensitive ink by an optical system that includes a scanning element for moving the light from one nozzle to another. A variety of optical scanning elements may be used in such a system, including scanning mirrors, scanning prisms and rotating mirror polygons. Furthermore, the system may be made compact by employing scanning micromachined mirrors that can be fabricated on silicon. Alternatively, light from an array of individually controllable light sources, such as an array of light emitting diodes or a semiconductor laser array may be imaged directly onto the array of inkjet nozzles by an optical imaging system. By selectively turning on the light sources in the array it is possible to choose the ink nozzles that are illuminated thereby selecting which nozzles release an ink drop. A third scheme employs a spatial light modulator with a number of discrete controllable pixel elements placed between the light source and the ink nozzle array. The spatial light modulator may be either transmissive, such as a transmissive LCD array, or reflective, such as a micromirror array. The light reflected or transmitted by the spatial light modulator is used to selectively illuminate the nozzle array.

Therefore, the present invention provides for an inkjet printer which utilizes an ink release system comprising light-sensitive ink for selective application to a receiver. An advantage of the present invention is that a full-color image for each color of the image can be printed in one pass, to thereby increase the printing speed. Further, the ink can be substantially aqueous and therefore environmentally friendly. Also, heater 40 can be a low power heater and thus reliable. This lessens the risk of kogation of the heater. Further, the printer of the present invention utilizes low power.

The invention has been described in detail with particular reference to certain preferred embodiments thereof, but it will be understood that variations and modifications can be effected within the spirit and scope of the invention.

What is claimed is:

1. A printing apparatus comprising:

a plurality of nozzles, each of said nozzles comprising a channel having an ink body disposed therein which is comprised of light sensitive ink, the channel of said nozzle leading to a nozzle outlet such that an unextended droplet meniscus attached to said ink body is located at said nozzle outlet; and a light source which is adapted to direct a light beam to said unextended droplet meniscus to cause an extension of said unextended droplet meniscus, so as to form an extended droplet meniscus and permit ink to be transferred to a receiver which is disposed relative to said extended droplet meniscus;

wherein said plurality of said nozzles are disposed on a multi-sided carousel, said multi-sided carousel being rotatable between at least a first position which locates said unextended droplet meniscus at a position to receive light from said light source to form said extended droplet meniscus, and a second position which locates said extended droplet meniscus at a position relative to the receiver so as to transfer said ink to the receiver.

2. A printing apparatus according to claim 1, further comprising a heater which surrounds said nozzle outlet, said heater causing said extended droplet meniscus to further extend and contact said receiver.

3. A printing apparatus according to claim 1, further comprising a heater which surrounds said nozzle outlet, said heater causing said extended droplet meniscus to further extend and fly-off toward said receiver.

4. A printing apparatus according to claim 1, further comprising a transducer which applies a pressure pulse to said extended droplet meniscus to cause said extended droplet meniscus to fly-off toward said receiver.

5. A printing apparatus according to claim 1, further comprising a transducer which applies a pressure pulse to said extended droplet meniscus to cause said extended droplet meniscus to further extend and contact said receiver.

6. A printing apparatus according to claim 1, further comprising an electrical field applicator which applies an electrical field to said extended droplet meniscus to cause said extended droplet meniscus to fly-off toward said receiver.

7. A printing apparatus according to claim 1, further comprising an electrical field applicator which applies an electrical field to said extended droplet meniscus to cause said extended droplet meniscus to further extend and contact said receiver.

8. A printing apparatus according to claim 1, further comprising a light emitting diode positioned in a vicinity of said nozzle outlet, said light emitting diode directing a further light beam at a throat of said nozzle which causes said extended droplet meniscus to fly-off toward said receiver.

9. A printing apparatus according to claim 1, further comprising a light emitting diode positioned in a vicinity of said nozzle outlet, said light emitting diode directing a further light beam at a throat of said nozzle to cause said extended droplet meniscus to further extend and contact said receiver.

10. A printing apparatus according to claim 1, wherein the printing apparatus is an inkjet print head.

11. A printing apparatus according to claim 1, wherein said light sensitive ink has a surface tension that decreases when exposed to the light beam so as to cause said extension of said droplet meniscus.

12. A printing method comprising the steps of:

forming unextended light-sensitive ink droplet menisci at outlets of a plurality of nozzles;

providing said nozzles on a rotating carousel;

impinging a light beam onto at least one of the unextended ink droplet menisci to form an extended ink droplet meniscus;

rotating said carousel so that said extended ink droplet meniscus faces a receiver; and transferring ink from said extended ink droplet meniscus onto the receiver.

13. A method according to claim 12, comprising the further step of:

heating an area surrounding said outlet of said nozzle to further extend said extended ink droplet meniscus.

14. A method according to claim 12, comprising the further step of heating an area surrounding said nozzle outlet, to cause said extended droplet meniscus to further extend and fly-off toward said receiver.

15. A method according to claim 12, comprising the further step of applying a pressure pulse to said extended droplet meniscus to cause said extended droplet meniscus to fly-off toward said receiver.

16. A method according to claim 12, comprising the further step of applying a pressure pulse to said extended droplet meniscus to cause said extended droplet meniscus to further extend and contact said receiver.

17. A method according to claim 12, comprising the further step of applying an electrical field to said extended droplet meniscus to cause said extended droplet meniscus to fly-off toward said receiver.

18. A method according to claim 12, comprising the further step of applying an electrical field to said extended droplet meniscus to cause said extended droplet meniscus to further extend and contact said receiver.

19. A method according to claim 12, comprising the further step of directing a further light beam at a throat of said nozzle to cause said extended droplet meniscus to fly-off toward said receiver.

20. A method according to claim 12, comprising the further step of directing a further light beam at a throat of said nozzle to cause said extended droplet meniscus to further extend and contact said receiver.

* * * * *